US005375828A

United States Patent [19]

Shikami

[11] Patent Number: 5,375,828

[45] Date of Patent: Dec. 27, 1994

[54] CUP LID GAME

[75] Inventor: Alan Shikami, Northbrook, Ill.

[73] Assignee: Creata, Inc., Wilmette, Ill.

[21] Appl. No.: 147,863

[22] Filed: Nov. 4, 1993

[51] Int. Cl.[5] ..... A63F 7/04

[52] U.S. Cl. ..... 273/110; 40/307; 273/112; 273/115; 273/116; 273/399; 446/74

[58] Field of Search ..... 446/73, 74, 75, 76, 446/77; 40/306, 307; 229/206.1; 273/1.5 R, 1.5 A, 108, 109, 110, 112, 113, 114, 115, 116, 399, 400, 402

[56] References Cited

U.S. PATENT DOCUMENTS

| | | | |
|---|---|---|---|
| 747,989 | 12/1903 | Leonard | 273/110 |
| 933,429 | 9/1909 | Gitterman | 273/145 C |
| 971,532 | 10/1910 | Fachmann | 273/112 |
| 1,280,300 | 10/1918 | Recker | 273/115 X |
| 2,792,696 | 5/1957 | Stayert | 446/76 X |
| 2,813,720 | 11/1957 | Bascle | 273/138 |
| 2,954,230 | 9/1960 | Rogers | 273/117 |
| 3,441,278 | 4/1969 | Edwards | 273/399 X |
| 3,724,855 | 4/1973 | Chu | 273/399 |
| 3,756,603 | 9/1973 | Goldfarb et al. | 273/108 |
| 3,782,028 | 1/1974 | Kelly | 46/41 |
| 4,007,936 | 2/1977 | Hornsby, Jr. | 273/115 |
| 4,074,827 | 2/1978 | Labe, III | 229/206.1 X |
| 4,177,992 | 12/1979 | Todokoro | 273/399 X |
| 4,239,223 | 12/1980 | Wilson | 273/115 X |
| 4,537,401 | 8/1985 | Smith et al. | 273/112 |

*Primary Examiner*—William H. Grieb
*Attorney, Agent, or Firm*—Howard & Howard

[57] ABSTRACT

A combination drinking glass lid and game includes a base which operates to cover and seal a drinking glass. The base includes an opening there through for passage of a drinking straw. Supported upon the base is a game of skill or chance, such as a target game.

4 Claims, 3 Drawing Sheets

CUP LID GAME

FIELD OF THE INVENTION

This invention relates generally to closures for drinking vessels. More particularly, the invention relates to lids for beverage cups. Specifically, the invention relates to a beverage cup lid which incorporates an integral game of skill or chance.

BACKGROUND OF THE INVENTION

As society becomes more mobile, the demand for carry out food and beverages is increasing. Cup lids are necessary in order to prevent spillage of beverages during transport and also during consumption, particularly by young children or by others who are at public events or in a mobile environment. Concomitant with the increase in volume of carry out food service, is increasing competitiveness among fast food merchandisers. Toward that end, merchants often offer purchase incentives, such as uniquely decorated serving materials, premiums and the like to consumers.

The present invention provides a drink cup lid which also functions as a game of skill or chance. As such, the present invention provides a unique marketing tool, particularly suited for the fast food industry. The lid of the present invention is uniquely configured to provide a game which may be played while the lid is attached to the drink, without spillage of the drink. Furthermore, the game lid provides a premium which may be removed from the drink after consumption and retained by the customer. As such, the present invention provides a purchase incentive for a customer. Additionally, the lid of the present invention may also be utilized as a souvenir at concerts, sporting events, amusement parks and the like, and as such, may constitute a value added item, allowing beverages to be sold at a premium price.

While the prior art has long employed drink lids of various configurations, such lids have not heretofore been integrated with games of the type described herein. U.S. Pat. No. 4,239,223 discloses a drinking glass having a game of skill integral with the base thereof. This item is relatively difficult to manufacture and does not lend itself to being used as a promotional premium; more importantly, the game cannot be played until after the drink is consumed, because of problems of spillage and the fact that any beverage in the glass will obscure the game portion. U.S. Pat. No. 933,429 discloses a cup having a chamber integral with the base thereof for containing a number of dice. This device is thus similar to that of the '223 patent. U.S. Pat. No. 1,280,300 discloses a flashlight case having a game of skill integral with one end thereof. None of the prior art provides any type of drink lid closure, much less a closure configured in accord with the principles and objectives of the present invention.

BRIEF DESCRIPTION OF THE INVENTION

There is disclosed herein a combination game and drinking vessel lid comprising:

a vessel closure member including a base having a retainer associated therewith for removably attaching the base to a drinking vessel, and an opening through the base which is configured to receive a drinking straw. The cover further includes a game assembly affixed to and supported by the base. The game assembly includes a transparent cover disposed in spaced apart relationship with the base so as to define a playing region there between, a playing piece retained in the playing region and a playing piece receptacle disposed in the playing region.

In particular embodiments, the base includes a rim disposed about the perimeter thereof and the retainer comprises a projecting portion of the rim.

In some embodiments, the game assembly includes a shooter which functions to project the playing piece through the playing region, and the playing piece receptacle comprises a target configured to permit the playing piece to pass there through. In other embodiments, the receptacle includes a series of detent openings which permit the playing piece to pass only part way there through; and in yet other embodiments, the playing piece receptacle comprises a maze or labyrinth through which a spherical playing piece is rolled.

In some embodiments, the game includes a playing surface defined between the base and cover, and in a specific embodiment, the playing surface is moveable within the playing region to cause a spherical playing piece to roll there across. In one specific embodiment of game including the moveable playing surface, the game assembly includes a cylindrical coupling member which is joined to the base by a flexible portion thereof. The coupler includes a passageway which is configured to receive and retain a drinking straw. The passageway is in communication with the opening in the base, and the playing surface is supported by the coupler so that the straw may be used in the manner of a joystick to tilt the playing surface within the playing space and thereby roll the playing piece there across.

In another embodiment, the invention is configured as a roller coaster game in which a spherical playing piece is propelled to the top of a roller coaster track for travel there along. In other embodiments, the game is configured as a basketball game, a hockey game, a baseball game, a target shooting game or a hockey game.

DETAILED DESCRIPTION OF THE INVENTION

Figure 1:
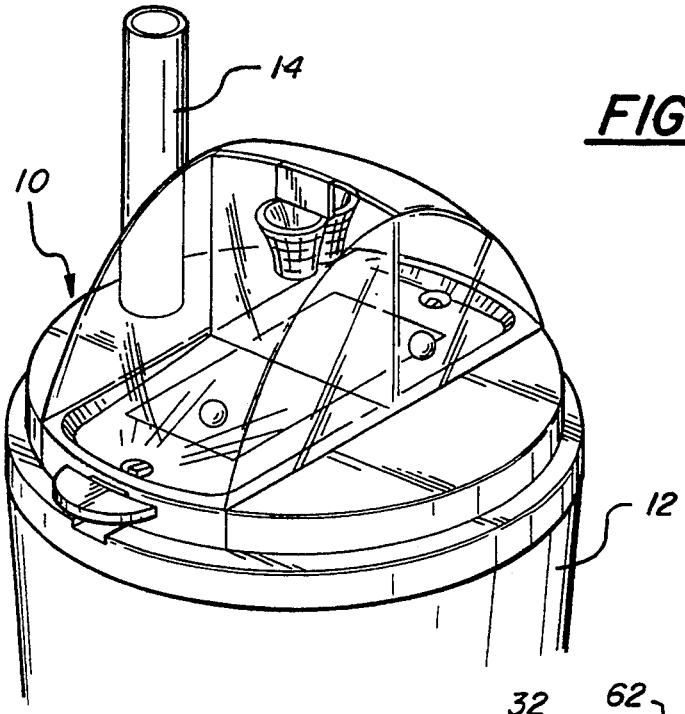
FIG. 1 is a perspective view of one embodiment of the present invention configured as a basketball game.

The present invention is directed to a combination game and drinking vessel lid. The lid includes a closure member which is a generally planar base configured to cover and be retained by a drinking cup. Disposed upon the base is a game assembly as will be detailed herein below. Referring now to FIG. 1, there is shown, in perspective, one particular embodiment of the present invention structured as a basketball game 10, which is attached to a drink cup 12. The lid encloses the cover 12 and provides access for a drinking straw 14. It will be noted that the straw 14 need not be removed for play of the game, and the game may be played without tipping or otherwise moving the cup 12.

Figure 2:
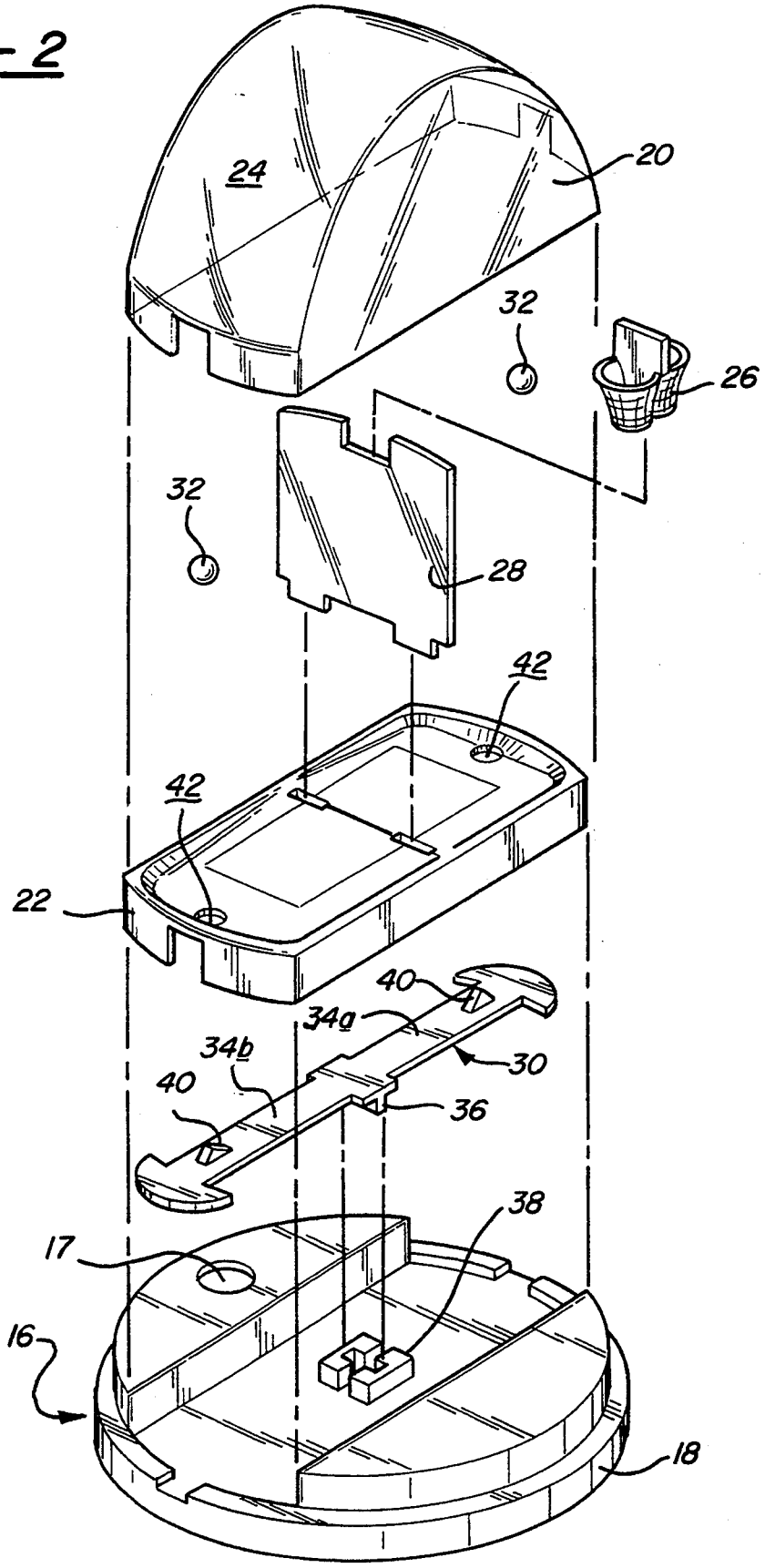
FIG. 2 is an exploded view of the game of FIG. 1.

Referring now to FIG. 2 there is shown an exploded view, in perspective, of the game of FIG. 1. The lid includes a base member 16 of generally planar configuration. As will be noted from the figure, the base member 16 is circular so as to permit its attachment to a round cup. The base member 16, also includes an opening 17 defined there through, which is configured to receive a drinking straw. The opening 17 may be a complete opening, or it may constitute a perforation, slit, or thinned portion of the base which is adapted to be pierced by a drinking straw. In the context of this disclosure, all of the foregoing shall be defined as an opening. It will also be noted that various structural features are present on the base 16 and it is to be understood that within the present disclosure a planar base member is defined to include associated structures formed from, or supported thereupon. In some instances, the upper surface of the base member 16 may be of concave, convex or other such configuration in order to accommodate play of the game. The base member 16 includes a rim portion 18, which in this embodiment is a generally cylindrical rim. The rim 18 is configured to engage and retain a cup, and toward this end may include gripping portions, protrusions and the like, as will be explained in detail herein below.

The FIG. 2 embodiment further includes a transparent cover 20 which, when assembled, is disposed in spaced apart relationship with the base 16. The cover and base define a playing region 24 them between. As illustrated, the cover 20 is a generally truncated dome, although it is to be understood that various other configurations of cover may be employed; and portions of the transparent cover may be opaque, provided sufficient area of the cover is transparent to permit play of the game. The FIG. 2 embodiment further includes a playing surface or game base 22 supported on the base member 16 within the playing region 24. Supported upon the playing surface 22 is a playing piece receptacle, or target assembly, which in this embodiment includes a set of basketball goals 26 and an associated backboard 28. When assembled, the goals 26 are supported by the backboard 28, which in turn is supported by the playing surface 22.

The FIG. 2 embodiment further includes a set of generally spherical playing pieces 32 and a shooter assembly 30 which is operative to project the playing pieces 32 through the playing region 24 toward the goals 26. In this embodiment, the shooting assembly 30 comprises a pair of resilient beams 34(*a*), 34(*b*) joined at a central fixture 36, configured to be retained in a socket 38 in the base member 16. Each of the resilient beams 34(*a*) has a shooting wedge 40 defined thereupon. The wedge 40 projects through a corresponding opening 42 in the playing surface 22 to engage and project the ball 32. In the illustrated embodiment, the various components of the shooter assembly 30 are preferably manufactured from a resilient polymeric material such as polystyrene, polyvinyl and the like, although it is to be understood that metals, composites, and various other materials may be utilized in accord with the present invention.

The embodiment of FIGS. 1 and 2 is configured as a basketball game. It is to be understood that by simple modification thereto, other, similar games could be made. For example, the basketball goals could be replaced by a set of football goalposts. Also, the nets could be removed and the backboard portion provided with appropriate openings there through and graphic designs to simulate a hockey goal, a soccer goal, or various other targets.

Figure 3:
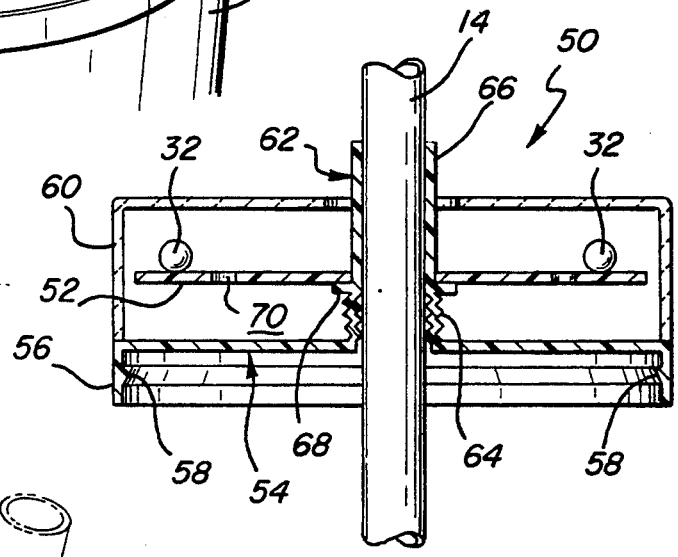
FIG. 3 is a cross sectional view of another embodiment of the present invention configured as a joystick operated game.

It will be appreciated that within the context of the present invention, numerous other embodiments will be apparent to skill in the art. Referring now to FIG. 3, there is shown a cross-sectional view of another embodiment of game lid structured in accord with the principles of the present invention. The lid 50 of FIG. 3 comprises a joystick operated game wherein a series of spherical playing pieces 32 are rolled across a playing board 52. The FIG. 3 embodiment includes a base member 54 having a generally cylindrical rim portion 56 associated therewith. The rim portion includes a projection 58 configured to engage a drink cup so as to retain the lid 50 thereupon. As illustrated, the projection 58 is a ramp-like member, although it is to be understood that various other configurations of retaining member, such as a plurality of fingers, a tapered surface, a number of indentations and the like may be similarly employed.

A transparent cover 60 is supported by the base member 54 and the two combine to define a playing region 24 there between. As illustrated, the transparent cover 60 is a generally planar member including a projecting side wall which is joined to the base member 54. It is to be understood that the cover may likewise be configured as a dome; alternatively, the cover may be a simple planar sheet and the base member 54 may include an upwardly projecting rim corresponding to the side wall of the cover 60, and the cover may then be joined to the upwardly projecting rim. As noted above, the cover, whatever its configuration, should have sufficient optical transparency across a portion of its surface to permit play of the game.

In the FIG. 3 embodiment, the lid further includes a cylindrical coupler 62 which is affixed to the base member 54. The coupler 62 includes at least one flexible portion 64, shown herein as a corrugated portion. In the illustrated embodiment, the coupler 62 further includes a non-corrugated, relatively rigid portion 66. The playing board 52 is retained and supported by the coupler 62, in this embodiment, by a combination of a press fit and a supporting ring 68 integral with the coupler 62. It is to be understood that the game board 52 may be otherwise affixed to the coupler 62, as for example by adhesive or the like. Also, in the illustrated embodiment, the coupler 62 is shown as being affixed to the support member 54, and it is to be understood that the coupler could be molded to be integral therewith.

As in the previous embodiment, the lid 50 is configured to permit passage of a drinking straw 14 there through, and toward this end includes an opening defined through the base member 54 as well as a cylindrical passageway through the coupler 62, which is configured to receive and retain the drinking straw 14.

When the FIG. 3 embodiment is in use, the flexible portion 64 of the coupler 62 permits motion of the coupler 62 which thereby causes the playing board 52 to tilt within the playing region 24. As illustrated, the playing board 52 includes a number of detent openings 70 there through. These openings are sufficiently small to prevent passage of the spherical playing pieces 32 there through, but do function to hold the pieces to some degree. In the FIG. 3 embodiment, it will be appreciated that the drinking straw 14 can be used in the manner of a joystick to tilt the gameboard 52 and appropriately move the playing pieces 32 there across. In an alternative embodiment, the coupler may be extended to form a joystick and the lid configured to include a differently placed opening for the straw.

Figure 4:
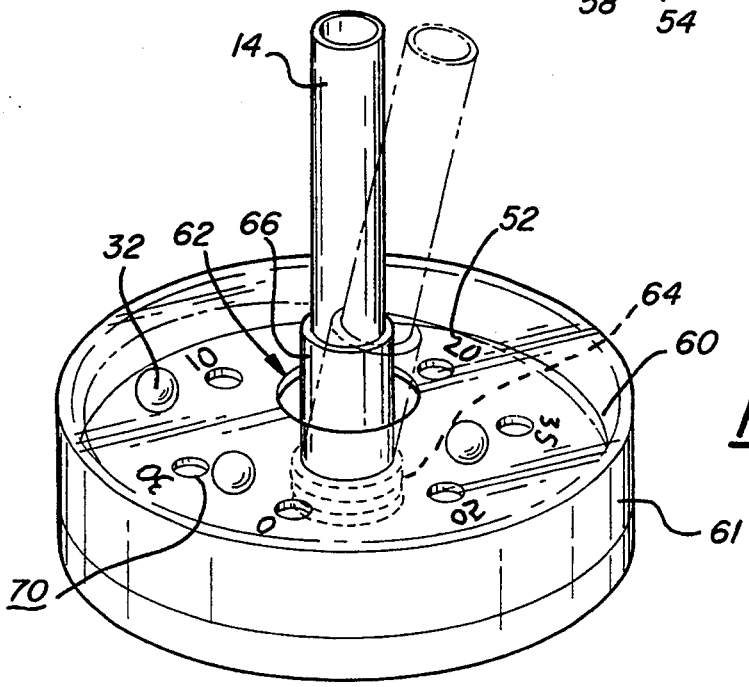
FIG. 4 is a perspective view of the game of FIG. 3.

Referring now to FIG. 4, there is shown a perspective view of the lid 50 of FIG. 3 illustrating the playing board 52, detent openings 70, playing pieces 32, and the rigid 66 and flexible (shown in phantom at 64) portions of the cylindrical connector 62. It will be noted that in the illustrated embodiment, the transparent cover 60 includes an opaque side portion 61, which in this embodiment, is formed integral with the base member (54 in FIG. 3).

Figure 5:
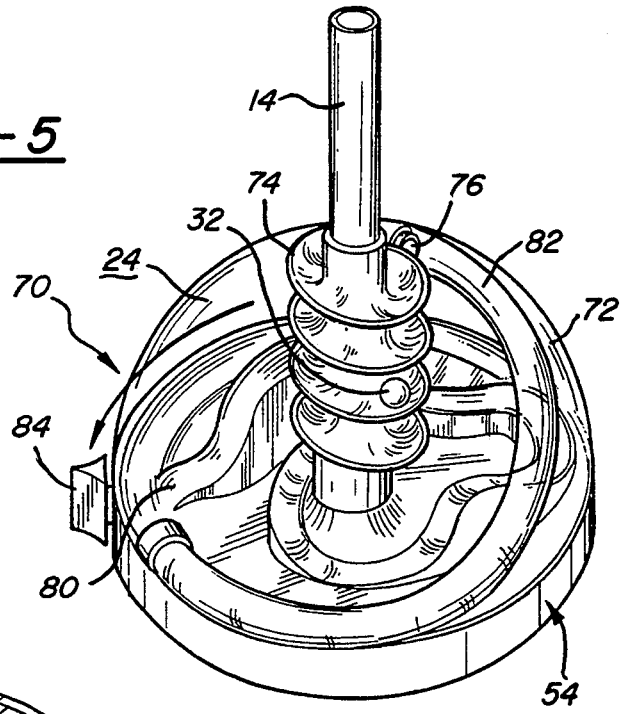
FIG. 5 is a perspective view of another embodiment of the present invention structured as a roller coaster game.

FIG. 5 depicts yet another embodiment of the present invention configured as a roller coaster game 70. In the FIG. 5 embodiment, the lid 70 includes a transparent, dome-like cover 72 which encloses a playing region 24 within which roller coaster track 74 is disposed. The track 74 includes a first end 76 and a second end 80, with the first end 76 being elevated, in relation to the base member 54, as compared to the second end 80. The track 74 is configured so that a ball placed thereupon will roll from the first end 76 to the second end 80. The game portion of the lid 70 further includes a conduit, which in this instance is a transparent plastic tube 82, which establishes mechanical communication between the first end 76 and second end 80 of the track. Also included in the lid 70 is a flipper lever 84 which may be resiliently biased to store energy, and which, when released, will transfer energy to a spherical playing piece driving it up the conduit 82 to the first end 76 of the roller coaster track 74. The playing piece will then roll back down the track to the second end thereof and may be again driven up the conduit 82. The flipper lever 84 may be spring biased, or may be a resilient, self-biased member somewhat similar to that shown at reference 30 at FIG. 2. In the illustrated embodiment 70 of FIG. 5, it will be noted that the first portion of the roller coaster track 74 is configured as a spiral which surrounds a passageway configured to receive a drinking straw 14, and the dome 72 includes an opening configured to permit the straw to pass there through. Clearly, other arrangements are contemplated within the scope of the present invention.

Figure 6:
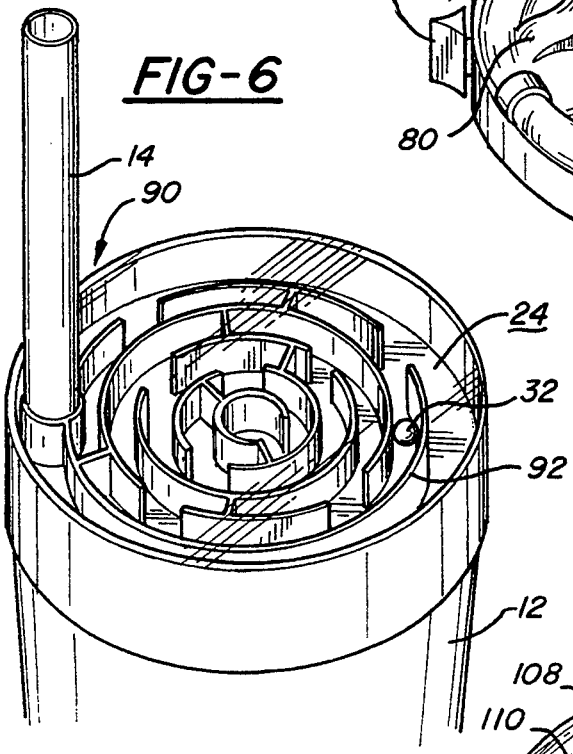
FIG. 6 is a perspective view of another embodiment of the present invention structured as a labyrinth game.

Referring now to FIG. 6, there is shown yet another embodiment of the present invention 90, configured as a labyrinth game. In this embodiment, a labyrinth or maze 92 is disposed within the playing region 24. The labyrinth 92 is configured to permit a sphere 32 to roll there through as the cup 12 and associated lid 90 are tipped. Clearly, within the context of the present invention, other configurations of maze, including multi-level mazes, may be utilized. Furthermore, this particular embodiment may also be structured to include the joystick moveable playing surface depicted in FIGS. 3 and 4.

Figure 7:
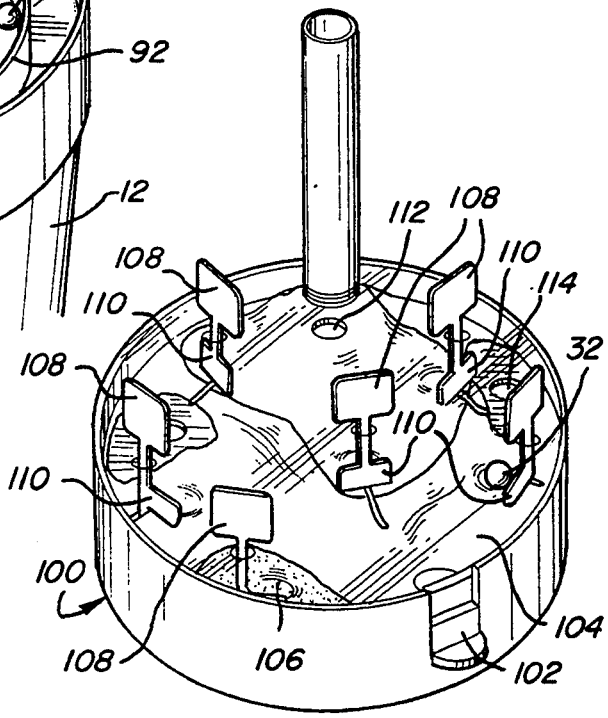
FIG. 7 is a perspective view of another embodiment of the present invention structured as a golf game.

Yet another embodiment of lid 100 is depicted in FIG. 7. This embodiment 100 comprises a golf game. In this embodiment, a resiliently biased ejector 102 is disposed to raise a ball 32 from a lower level and to project it along a playing surface 104 which is configured as a golf course. The playing surface includes a number of depressions 106 similar to the aforementioned detent openings. The depressions 106 function to retain the ball 32 therein. Proximate each depression 106 is a resilient ball striking member 108 which includes ball striking face 110 associated therewith. The striking member 108 is biased by the player and stores energy. When the member is released, the striking portion 110 propels the ball. The playing surface includes a target hole 112 toward which the ball is driven. The playing surface also includes a number of trap holes 114, into which the improperly driven ball will fall. When the ball falls into either of holes 112 114, it travels back along an inner surface, beneath the playing surface 104 to the area of the ball ejector 102. When the ejector 102 is pressed down, it raises the ball from the lower level and begins the play cycle again.

Clearly, other embodiments are also possible within the scope of the present invention. The game of the present invention may be structured as a pinball game and may include manually operated flipper levers. The game may also be structured as a target shooting game and might include moveable targets which flip or spin when struck by a projectile. While in various of the foregoing embodiments, a resiliently loaded striking element is used to propel a playing piece, it will be appreciated that other means of propelling a piece, such as compressed air delivered from a small syringe or a bellows may be similarly employed. In other embodiments of the present invention. the playing piece may comprise a spinning member such as a top or gyroscope, activatable through the transparent covering and disposed to spin within the playing region.

In view of the foregoing, it will be appreciated that the invention may be practiced in a number of forms, other than those illustrated herein. The foregoing drawings, discussion, description and examples are merely meant to illustrate particular embodiments of the present invention, and are not meant to be a limitation upon the practice thereof. It is the following claims, including all equivalents, which define the scope of the invention.

I claim:

1. A combination game and drinking vessel lid comprising:

A vessel closure member comprising a base having a retainer associated therewith for removably attaching said base to a drinking vessel, and an opening, which is configured to receive a drinking straw, defined through said base; and A game assembly affixed to, and supported by said base, said game assembly including a transparent cover disposed in spaced apart relationship with said base so as to define a playing region there between, a spherical playing piece retained in said playing region, a roller coaster track disposed in the playing region, said track configured to permit a playing piece to roll there along, and including a first end and second end, said first end disposed at a higher elevation relative to the base than the second end, a conduit in mechanical communication with the first end and the second end of the roller coaster track, said conduit configured to permit passage of the playing piece there through, and a shooter associated with the conduit for propelling the playing piece through the conduit from the first end of the roller coaster track to the second end thereof.

2. A lid as in claim 1, wherein at least a portion of said roller coaster track is a spiral track which is disposed about a central, cylindrical passageway, which passageway is configured to receive a drinking straw therein, said passageway being disposed in communication with the opening defined through the base.

3. A combination game and drinking vessel lid comprising:

a vessel closure member comprising a base having a retainer associated therewith for removably attaching said base to a drinking vessel and an opening, which is configured to receive a drinking straw, defined through said base; and a game assembly affixed to, and supported by said base, said game assembly including a transparent cover disposed in spaced apart relationship with said base so as to define a playing region there between; a generally spherical playing piece retained in said playing region; a cylindrical coupler affixed to, and supported by the base, said coupler including a flexible portion and having a passageway configured to receive a drinking straw deemed there through, said passageway in communication with the opening in said base; a playing board disposed in said playing region and supported by the cylindrical coupler so that movement of the coupler through the flexible portion moves the playing board causing the playing piece to move there across.

4. A combination basketball game and drinking vessel lid comprising:

a base member having a rim which defines a perimeter thereof and which projects from said base and is configured to engage a drinking vessel so as to retain said base member thereunto, said base member including an opening configured to receive a drinking straw and a socket configured to receive and retain a member therein:

a transparent cover disposed in spaced-apart relationship with the base member so as to define a playing region therebetween;

a playing surface supported by the base member, within the playing region, in a spaced-apart relationship therewith so as to define a space therebetween;

a target assembly supported on the playing surface, said target assembly including a dual-sided backboard disposed so as to divide the playing region into a first and a second volume, said backboard having a first basketball goal supported on a first side thereof in said first volume and a second basketball goal supported on a second side thereof in said second volume;

a first, spherical playing piece disposed in said first volume;

a second, spherical playing piece disposed in said second volume;

a shooting assembly comprised of a first and a second resilient beam which are joined at a central fixture which includes a member which is retained in the socket defined in the base member, said shooting assembly being disposed so that said first and second resilient beams are supported in the space defined between said base member and playing surface, each of said resilient beams including a shooting wedge defined thereupon, the shooting wedge of the first resilient beam being disposed so as to project through a first opening defined through said playing surface in said first volume, and the shooting wedge of the second resilient beam being disposed so as to project through a second opening defined through said playing surface in said second volume.

* * * * *